US005347300A

United States Patent [19]

Futagawa

[11] Patent Number: 5,347,300

[45] Date of Patent: Sep. 13, 1994

[54] INK-JET PRINTER DRIVER

[75] Inventor: Yoshikiyo Futagawa, Nagano, Japan

[73] Assignee: Seiko Epson Corporation, Tokyo, Japan

[21] Appl. No.: 35,886

[22] Filed: Mar. 23, 1993

Related U.S. Application Data

[63] Continuation of Ser. No. 509,640, Apr. 17, 1990, abandoned.

[30] Foreign Application Priority Data

Apr. 17, 1989 [JP] Japan ..... 1-97162
Jul. 3, 1989 [JP] Japan ..... 1-171430
Oct. 20, 1989 [JP] Japan ..... 1-273051

[51] Int. Cl.[5] ..... B41J 2/01
[52] U.S. Cl. ..... 347/9
[58] Field of Search ..... 346/140 R, 75, 76 PH; 400/126

[56] References Cited

U.S. PATENT DOCUMENTS 4,240,081 12/1980 Devitt ..... 346/75
4,352,114 9/1982 Kyogohu et al. ..... 346/140 R
4,459,599 7/1984 Ort ..... 346/140 R
4,540,896 9/1985 Tanaka ..... 307/264
4,583,100 4/1986 Tazaki ..... 346/46
4,625,220 11/1986 Nagashima ..... 346/140 R
4,639,747 1/1987 Sakurada et al. ..... 346/140 R
4,651,164 3/1987 Abe et al. ..... 346/76 PH
4,835,549 5/1989 Samejima et al. ..... 346/76 PH

FOREIGN PATENT DOCUMENTS 3232441 3/1984 Fed. Rep. of Germany .

*Primary Examiner*—Benjamin R. Fuller
*Assistant Examiner*—N. Le
*Attorney, Agent, or Firm*—Cushman, Darby & Cushman

[57] ABSTRACT

An ink-jet printer driver for driving a plurality of electrostriction elements which jet out ink has a scanning voltage generating circuit for generating a scanning voltage having a predetermined waveform; a plurality of gate circuits for respectively giving the scanning voltage to the electrostriction elements corresponding to the gate circuits; and a driving signal generating circuit for giving driving signals to the gating circuits, respectively.

13 Claims, 7 Drawing Sheets

FIG. 7(a)
FIG. 7(b)
FIG. 7(c)
FIG. 7(d)
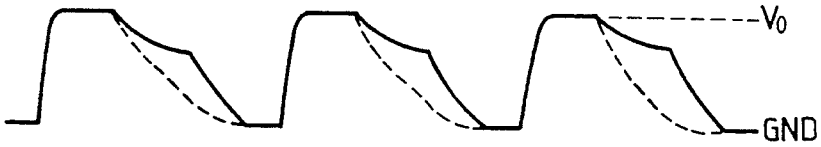
FIG. 8
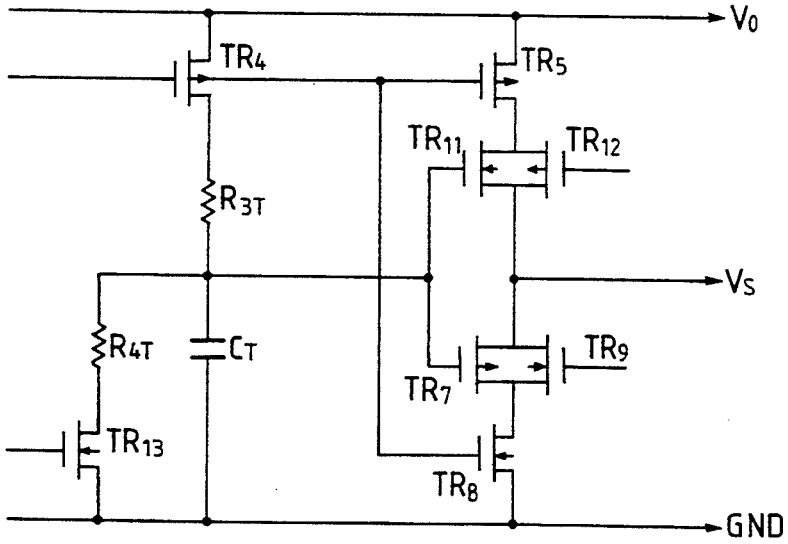

FIG. 9(a)
FIG. 9(b)
FIG. 9(c)
FIG. 9(d)
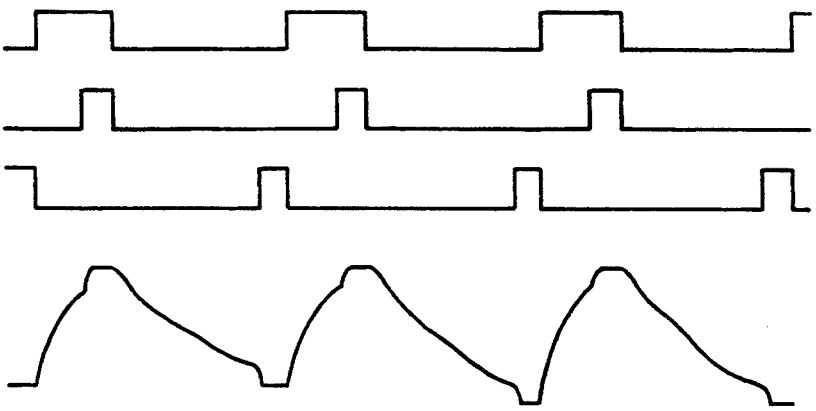
FIG. 10
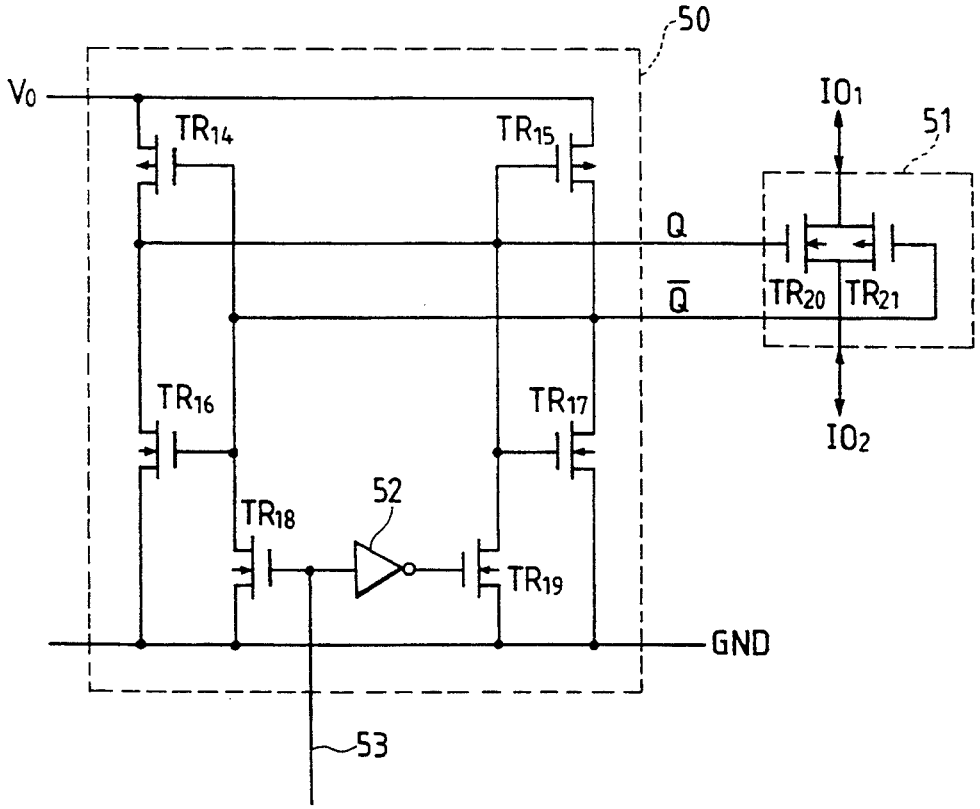

INK-JET PRINTER DRIVER

This is a continuation of application Ser. No. 07/509,640, filed on Apr. 17, 1990 abandoned.

BACKGROUND OF THE INVENTION

1. Field of the Invention

The present invention relates to an ink-jet printer driver in which electrostriction elements are caused to press ink to jet out of nozzles so as to form characters/-graphics with ink dot matrices.

2. Description of the Prior Art

Referring to FIGS. 11(*a*) through 11(*e*), construction of part of a head of an ink-jet printer according to the present invention will be described. In these figures, reference numeral 1 designates a nozzle plate having a nozzle 1*a*, 2 designates an elastic plate, 3 designates liquid ink, and 4 designates an electrostriction element which is distorted by an electric field. The electrostriction element is closely attached on the elastic plate 2.

FIG. 11(*a*) shows a standby condition in which the elastic plate 2 is projected toward ink by the distortion of the electrostriction element 4. FIGS. 11(*b*) through 11(*d*) show the steps in which the elastic plate 2 is recovered to its neutral point by gradually removing the electric field from the electrostriction element 4, respectively.

FIG. 11(*e*) shows a condition in which an electric field is suddenly applied to the electrostriction element 4 to make the elastic plate 2 project toward the ink 3 to thereby jet the ink 3 outward. If the application of the electric field is continued as it is, the head returns to its standby condition, as shown in FIG. 11(*a*).

In an alternative ink jetting method, the electrostriction element 4 is provided within the ink. The present invention is applied to both the methods.

A printer head is constituted by combining a plurality of aforementioned constructions. In the case of a serial printer, the number of the constructions is from 8 to 64. In the case of a page printer, the number of the constructions is from 1400 to 4000.

A conventional art for driving the aforementioned printer head is shown in FIGS. 12 and 13. In FIG. 12, reference numeral 5 designates a high-voltage electric source which, in general, has an output voltage $V_o$ within a range of from 50 to 200 V. The output voltage may vary in accordance with the characteristics of constituent parts due to the response frequency. Symbol $TR_S$ represents a P-type transistor for switching a voltage $V_o$ so as to feed a signal $V_x$ to the printer head. Reference numeral $6_i$ designates one driving circuit.

In the driving circuit $6_i$, an electrostriction element $7_i$ is charged to a voltage $V_0$ through a resistor $R_{3i}$ having a value of several MΩ, so that the situation is returned to the aforementioned standby state. A diode $D_i$ for isolating the driving circuit from other driving circuits and a resistor $R_{1i}$ serve to charge the electrostriction element $7_i$ rapidly. When an N-type transistor $TR_{Di}$ is turned on, the charge of the electrostriction element $7_i$ is absorbed through a resistor $R_{2i}$ having a larger resistance value than that of the resistor $R_{1i}$, so that the voltage drops as shown in the point A in FIG. 13(*b*). The symbol i attached to the driving circuit $6_i$, the electrostriction element $7_i$, and other parts in the driving circuit $6_i$ are used to show those parts or components representatively because a plurality of such driving circuits are provided respectively for a plurality of printer heads as described above.

Reference numeral 8 designates a driving signal generating means which serves to give a switching signal to the transistor $TR_S$ periodically. A driving signal is given to the transistor $TR_{Di}$ in accordance with existence of a dot forming instruction. FIG. 13(*a*) shows a state of the transistor $TR_S$ for performing a switching operation periodically.

In the case where the charge of the electrostriction element $7_i$ has been absorbed, the electrostriction element $7_i$ is charged rapidly through the diode $D_i$ and the resistor $R_{1i}$ during the ON-state of the transistor $TR_i$ so that ink is jetted as shown in FIG. 11(*e*). On the contrary, in the case where the electrostriction element $7_i$ has been charged to a value of $V_0$, the charged voltage of the electrostriction element $7_i$ does not change so that ink is not jetted.

The resistance value of the resistor $R_{1i}$ is selected to be several kΩ and the charging time constant is selected to be a value in a range of from 5 to 10 μs so as to prevent occurrence of wasteful ink jetting caused by overshooting of the elastic plate 2.

The resistance value of the resistor $R_{2i}$ is selected to be of the order of several tens of kΩ and the charging time constant is selected to be a value within a range of from 20 to 100 μs so as to prevent occurrence of both wasteful ink jetting caused by an undercoat and air suction from nozzles. If air is sucked into ink, it becomes impossible to perform ink jetting only by contraction of air.

The equivalent capacitance of the electrostriction element $7_i$ is within a range of from 100 to 1000 PF.

The foregoing is that related to a conventional ink-jet printer driver.

In the aforementioned prior art, however, there arises a problem in that elements having accurate values are required because a driving circuit $6_i$ is constituted by resistors $R_{1i}$, $R_{2i}$, $R_{3i}$ and a diode $D_i$ to obtain a driving waveform as shown in FIG. 13(*b*). Further, there arises another problem in that the degree of freedom cannot be obtained because the rising and falling characteristics are fixed. Furthermore, there arises a further problem in that an exact time constant is required making it difficult to prepare the circuits in the form of ICs, and, accordingly, assembling cost becomes high though the constituent parts or elements per se are inexpensive in cost.

In particular, as the number of nozzles is increased to 24, 64, . . . 3000, or in other words, the capacity of the printer is increased, the aforementioned problems become serious. On occasion, there may arise a defect in that assembly becomes impossible.

SUMMARY OF THE INVENTION

The present invention is directed to solve the above problems in the prior art, and a first object thereof is to provide an ink-jet printer driver in which charge absorbing/injecting characteristics of electrostriction elements used as main constituent parts of a printer can be set freely.

It is a second object of the present invention to provide an ink-jet printer driver in which constituent parts required for attaining the first object can be simplified to facilitate making the circuit in the form of ICs and to facilitate manufacturing large scale ink jet printers inexpensively.

In an ink-jet printer driver in which electrostriction elements are selectively actuated to press ink so that the ink is jetted out of nozzles corresponding to the selected electrostriction elements to thereby form characters/-graphics in dot matrices of the ink, the present invention has the following features.

The ink-jet printer driver comprises: a scanning voltage generating means for generating a scanning voltage having a predetermined waveform; a plurality of gating means for respectively giving the scanning voltage to the electrostriction elements corresponding to the gating means; and a driving signal generating means for giving driving signals to the plurality of gating means respectively. Thus, the number of constituent parts is reduced.

FIG. 4 is the scanning voltage generating means is composed of first and second switching means for defining the rising and falling of the scanning voltage, and a feedback circuit including coil means. Thus, the efficiency in energy exchange between a supply electric source and a load including the electrostriction elements is improved.

The scanning voltage generating means is composed of a time constant circuit constituted by a resistor and a capacitor, a switching means for actuating the time constant circuit to operate in a predetermined cycle, and an amplifier for putting out the voltage change caused in the time constant circuit as a low-impedance output signal. Thus, the voltage change is not affected by the load containing the electrostriction elements.

In the case where the ink-jet printer is a serial printer having a carriage of the type designed to move a printer head constituted by the nozzles and the electrostriction elements, the gating means and the driving signal generating means are mounted on the carriage to simplify a connection cable between the carriage and a fixed control portion of the printer. Thus, the number of electric source lines and the number of signal lines can be reduced and, accordingly, a connection cable between the carriage and a fixed control portion of the printer can be simplified to reduce cost.

As described above, in the prior art, time constants are set respectively in the individual drive elements. According to the present invention, however, the scanning voltage having a predetermined waveform is selected so that the driving elements can be simplified to facilitate integration of the circuits.

When the driving elements are prepared in the form of ICs, the driving elements can be mounted on the printer head easily, so that cost on the whole of the printer can be saved.

BRIEF DESCRIPTION OF THE DRAWINGS

Other features and advantages of the present invention will be apparent from the following description taken in connection with the accompanying drawings, wherein:

FIGS. 7(*a*)–7(*d*) are time charts showing the operation of the scanning voltage generating means depicted in FIG. 6;

FIG. 8 is a block diagram showing the configuration of a further embodiment of the scanning voltage generating means according to the present invention;

FIGS. 9(*a*)–9(*d*) are time charts showing the operation of the scanning voltage generating means depicted in FIG. 8;

FIG. 10 is a block diagram showing the detailed configuration of a specific example of the level changer and the gating means suitably employed in the invention;

DETAILED DESCRIPTION OF THE PREFERRED EMBODIMENTS

Figure 1:
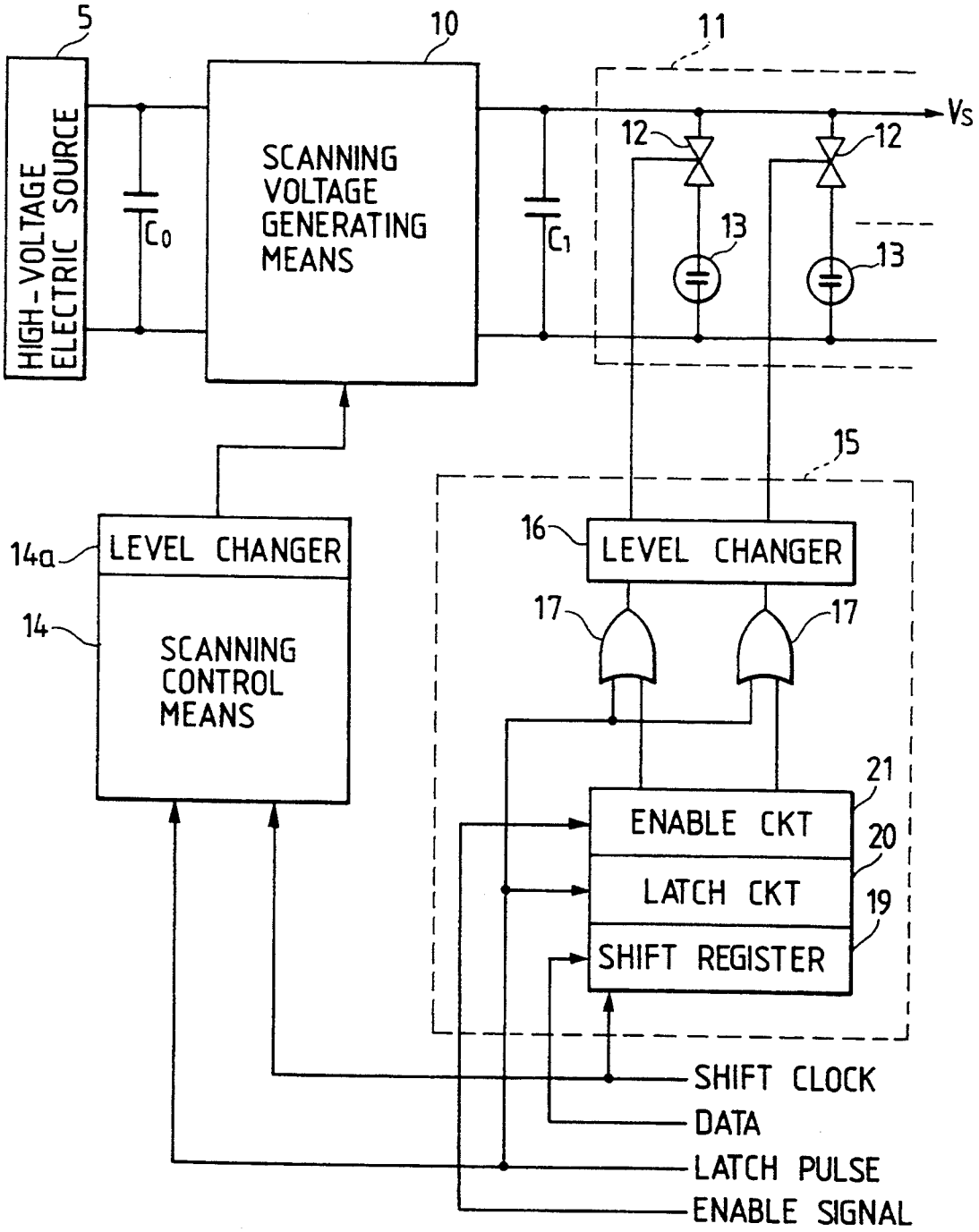
FIG. 1 is a block diagram showing an embodiment of the ink-jet printer driver according to the present invention.
Figure 2A:
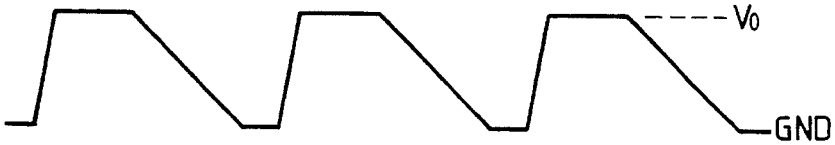
FIGS. 2(*a*)–2(*d*) are time charts showing the operation of the ink-jet printer depicted in FIG. 1.
Figure 2B:
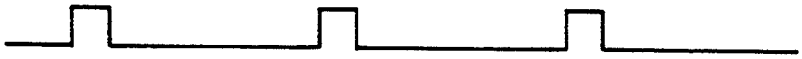
Figure 2C:
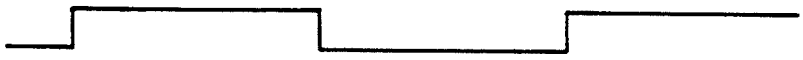
Figure 2D:
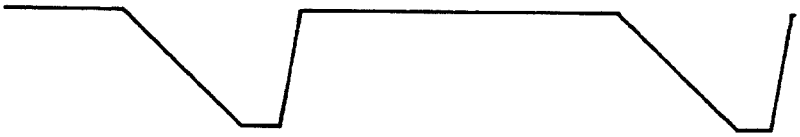

Referring to FIG. 1, there is shown an embodiment of the present invention. In FIG. 1, the symbol $C_o$ represents a smoothing capacitor included in a high-voltage electric source 5, and the symbol $C_1$ represents a capacitor inclusive of capacitance of electrostriction elements and additive capacitance.

The reference numeral 10 designates a scanning voltage generating means in which the output voltage changes within a range between $V_o$ and GND as shown in the waveform FIG. 2(*a*). The reference numeral 11 designates a driver portion composed of a plurality of gating means 12 and a plurality of electrostriction elements 13. Each gating means 12 selects a scanning voltage $V_S$ of the scanning voltage generating means 10 based on a driving signal to feed the scanning voltage to a corresponding electrostriction element 13. The reference numeral 15 designates a driving signal generating means for feeding a driving signal to a control terminal of each gating means 12.

The driving signal generating means 15 has a shift register 19 for storing data while successively shifting the data based on a shift clock signal, a latch circuit 20 for simultaneously latching the data stored by the shift register 19 based on a latch pulse signal, an enable circuit 21 for releasing the data latched by the latch circuit 20 based on an enable signal, two-input OR gates 17 for receiving both the data put out from the enable circuit 21 and the latch pulse signal, and a level changer 16 for changing the levels of the output signals of the OR gates 17 to feed control signals to the gating means 12. The level changer 16 serves to change the respective levels of the output signals of the OR gates 17 into $V_o$ to make the corresponding gating means operate. This is because the parts other than the driving signal generating means are operated at 5 V and therefore it is impossible to make the gating means operate unless the level of the output signal of each OR gate 17 is converted into $V_o$.

Figure 12:
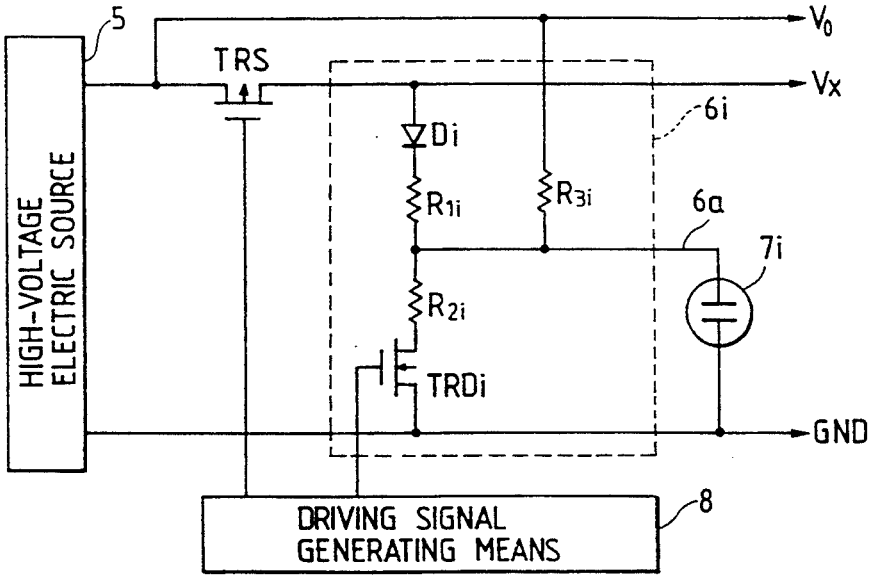
FIG. 12 (PRIOR ART)
FIG. 12 is a block diagram showing the configuration of an example of a conventional printer driver.

The latch pulse signal is fed to the OR gate 17 so that the gating means 12 is activated to apply the scanning voltage Vs to the electrostriction element 13 to compensate leakage of the electrostriction element 13 while the scanning voltage $V_S$ takes the value of $V_o$. In short, this serves for the resistor $R_{3i}$ in FIG. 12. FIG. 2(*b*) shows the latch pulse signal.

Figure 13A:
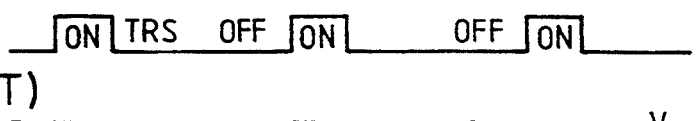
FIG. 13(a) (PRIOR ART)
FIGS. 13(*a*)–13(*b*) time charts showing the operation of the conventional printer driver depicted in FIG. 12.
Figure 13B:
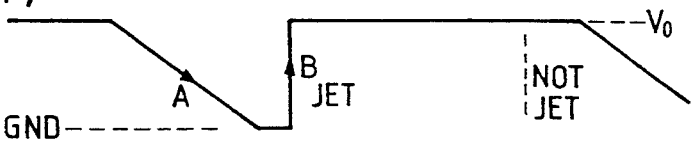
FIG. 13(b) (PRIOR ART)

FIG. 2(*d*) shows an example of the selection signal issued by the enable circuit 21 to jet ink. FIG. 2(*c*) shows an example of the waveform of the driving signal applied to the electrostriction element 13. In this example, ink is jetted out of nozzles corresponding to the electrostriction elements with their charged voltages lowered in the same manner as in FIG. 13(*b*).

The reference numeral 14 designates a scanning control means for feeding an operation timing signal to the scanning voltage generating means 10 after changing the level thereof by a level changer 14*a* based on both the shift clock signal and the latch pulse signal.

Figure 4:
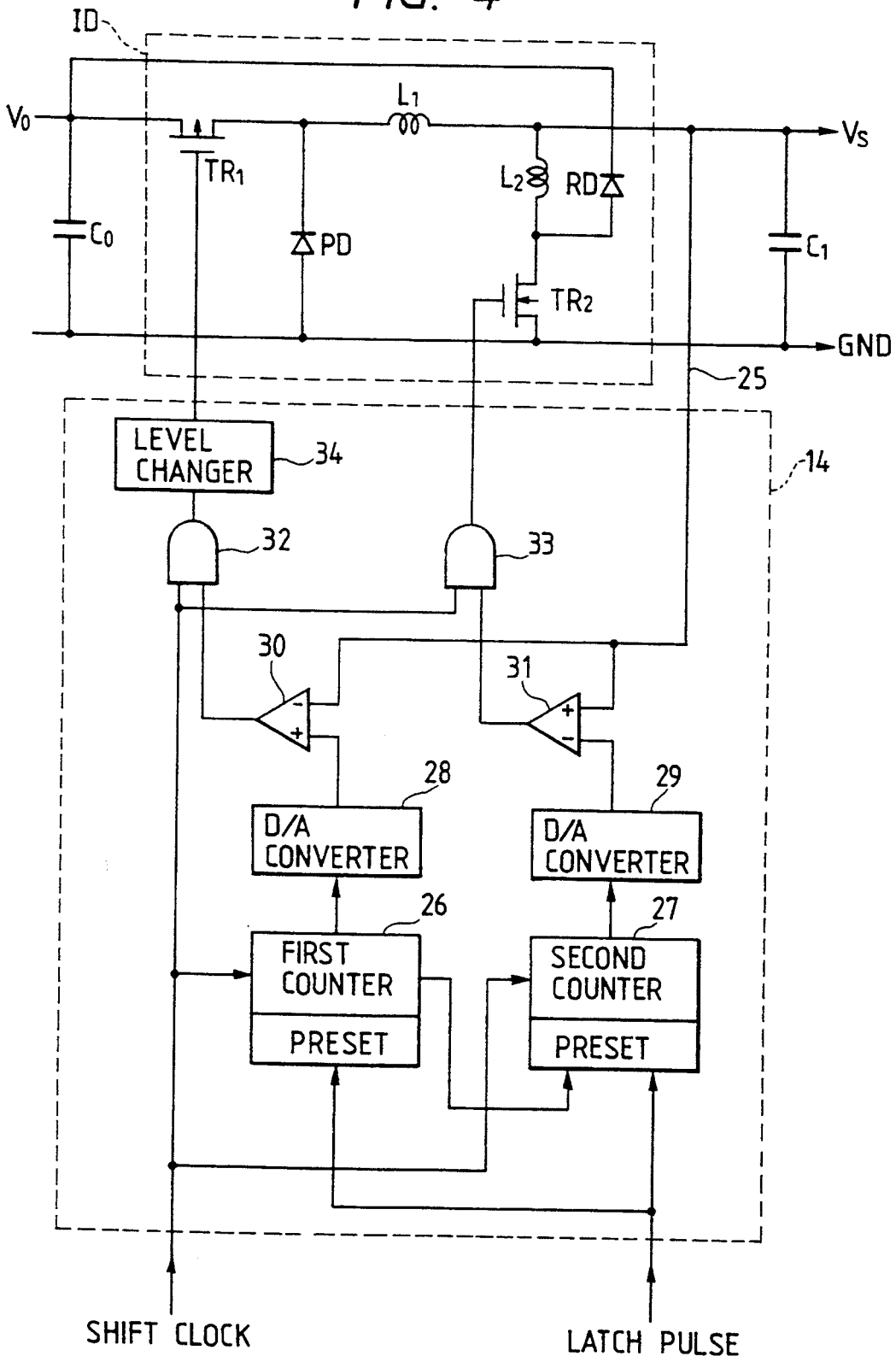
FIG. 4 is a block diagram showing the configuration of a specific embodiment of the scanning voltage generating means and the scanning control means in the ink-jet printer driver according to the invention.

Referring to FIG. 4, the scanning voltage generating means 10 and the scanning control means 14 according to the present invention are described in detail.

Figure 3A:
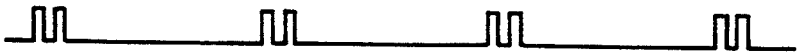
FIGS. 3(*a*)–3(*c*) are time charts showing the operation of the scanning voltage generating means and the scanning control means depicted in FIG. 4.
Figure 3B:
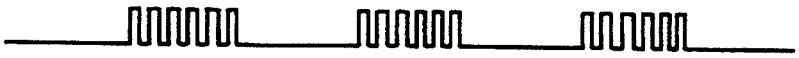
Figure 3C:
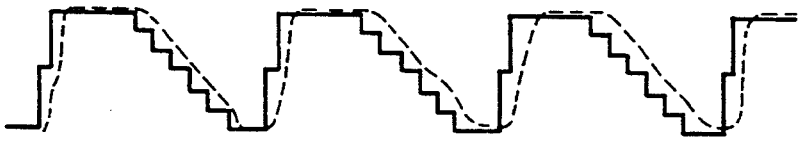

In FIG. 4, symbols $TR_1$ represents a P-type transistor which is supplied with an ON-OFF switching signal as shown in FIG. 3(*a*) by the scanning control means 14. When the transistor $TR_1$ is turned on, the the voltage $V_o$ is switched by the transistor $TR_1$ to charge the capacitor $C_1$ through a coil $L_1$. The scanning voltage $V_S$ is fed back to the scanning control means 14 through a line 25 to thereby control the ON-OFF switching signal in a manner as shown in FIG. 3(*a*).

When the transistor $TR_1$ is in the OFF state, a current flowing in the coil $L_1$ is passed through a diode PD to charge the capacitor $C_1$ further. When the charged voltage of the capacitor $C_1$ approaches $V_0$ according to the predetermined rising characteristic thereof, the transistor $TR_1$ is kept as it is in the OFF state.

The coil $L_1$ serves to charge the capacitor $C_1$ through the diode PD in the form of electromagnetic energy after the turn off of the transistor $TR_1$ to thereby prevent energy of the high-voltage electric source from being consumed by 50% or more by the resistors in the system.

At the time of the falling of the scanning voltage $V_S$, the scanning control means 14 feeds an ON-OFF switching signal as shown in FIG. 3(*b*) to an N-type transistor $TR_2$. The energy for charging the capacitor $C_1$ is converted into electromagnetic energy of a coil $L_2$ and then the electromagnetic energy is transferred to a capacitor $C_o$ through a diode RD after turning off of the transistor $TR_2$.

The capacitance value of the capacitor $C_1$ changes because it includes capacitance of selected electrostriction elements 13.

Accordingly, the scanning control means 14 adjusts energy transfer speed by controlling the number of times of switching of the transistor $TR_2$ while detecting the charged voltage of the capacitor $C_1$ to thereby attain the predetermined rising characteristic of the scanning voltage $V_S$.

The scanning voltage generating means 10 in FIG. 4 serves to generate a predetermined scanning voltage $V_S$ and perform energy exchange between the high-voltage electric source 5 and the capacitor $C_1$. Accordingly, wasteful power consumption can be saved.

In the following, the configuration of a specific embodiment of the scanning control means 14 for operating the scanning voltage generating means as described above will be described.

The reference numerals 26 and 27 designate first and second counters for counting the number of shift clock pulses. Each of the first and second counters 26 and 27 has a preset terminal for presetting both a start point of time and an operation time width in accordance with the latch pulse signal.

The reference numerals 28 and 29 designate digital-to-analog converters (hereinafter referred to as "D/A converters") for converting the contents of the first and second counters in the form of digital signals into analog signals, respectively.

The reference numerals 30 and 31 designate comparators with their one inputs supplied with the scanning voltage $V_S$ commonly to each other and their other inputs supplied with the output signals of the D/A converters 28 and 29 respectively. The comparators 30 and 31 output their output signals when the level of the scanning voltage $V_S$ is low and when it is high, respectively.

The reference numerals 32 and 33 designate AND gates with their one inputs supplied with the shift clock commonly to each other and their other inputs supplied with the output signals of the comparators 30 and 31 respectively. The frequency of the shift clock signal is set to a value in a range of from 100 kHz to several MHz.

The output signals of the AND gates 32 and 33 are respectively connected to the control electrodes of the transistors $TR_1$ and $TR_2$ after level-converted through a level changer 34 and directly, respectively.

The target scanning voltage and the result scanning voltage $V_S$ in the thus configured scanning voltage generating means 10 and the scanning control means 14 have waveforms shown in the solid line and the broken line in FIG. 3(*c*), respectively.

The configuration of another embodiment of the scanning voltage generating means 10 will be described with reference to FIG. 5.

Figure 5:
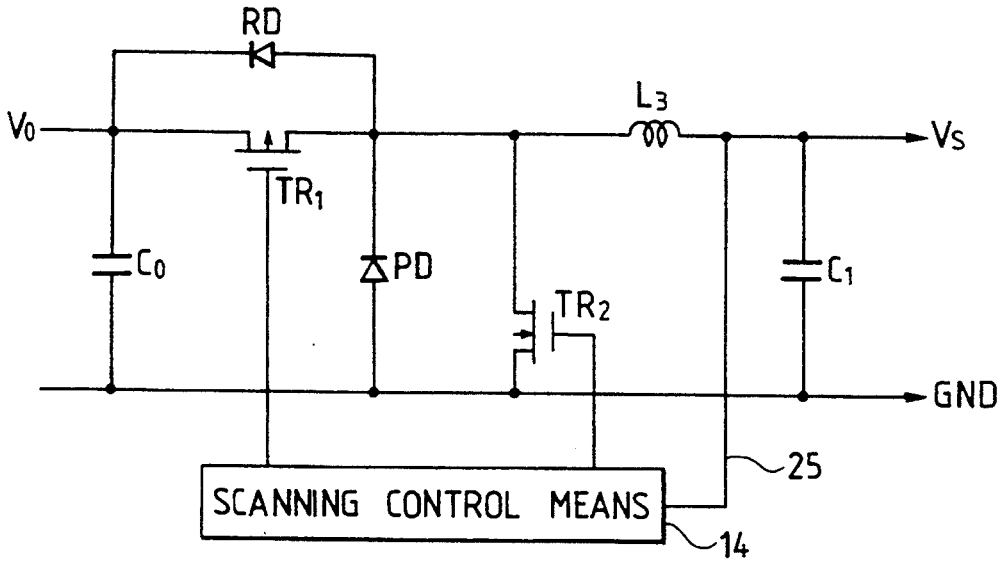
FIG. 5 is a block diagram showing the configuration of another embodiment of the scanning voltage generating means according to the invention.

The coils $L_1$ and $L_2$ of FIG. 4 are replaced by a single coil $L_3$ in FIG. 5. In FIG. 4, the two coils $L_1$ and $L_2$ are used to facilitate control because the rising of the scanning voltage $V_s$ and the falling thereof are different from each other.

In the embodiment of FIG. 5, therefore, the cost is saved though the controlling method shown is more or less complex.

Figure 6:
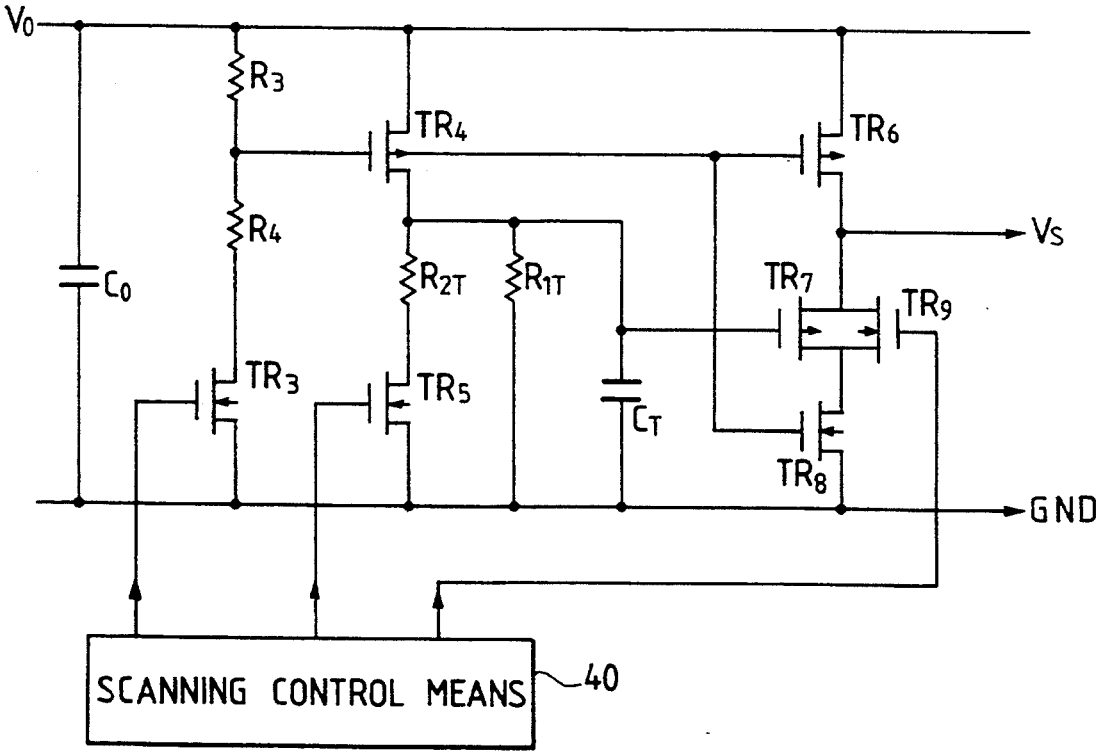
FIG. 6 is a block diagram showing the configuration of a further embodiment of the scanning voltage generating means according to the present invention, in which the scanning voltage generating means is constituted by a time constant circuit composed of a capacitor and a resistor.
Figures 11A, 11B, 11C, 11D, 11E:
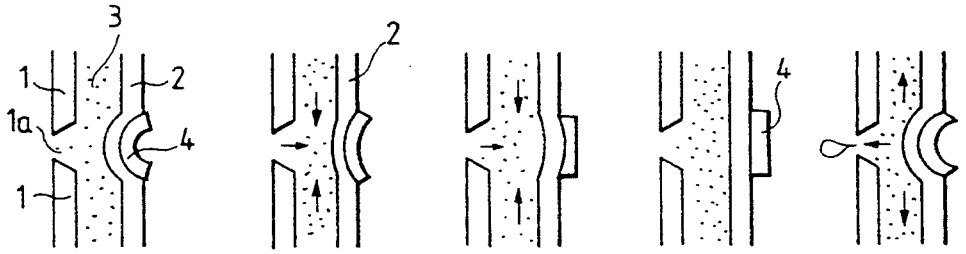
FIGS. 11(*a*)–11(*d*) show various states of one nozzle portion in an ink-jet printer for the purpose of explaining the principle of the operation of the ink-jet printer driver according to the invention.

In the following, the configuration of a further embodiment of the invention will be described with reference to FIG. 6. In this embodiment, the scanning voltage $V_S$ is generated by a time constant circuit composed of a capacitor and a resistor, without feedback control. In FIG. 6, a different reference numeral 40 is therefore given to the scanning control means. Resistors $R_3$ and $R_4$ and an N-type transistor $TR_3$ serve as a level changer to generate a signal as shown in FIG. 7(*a*) to turn-on P-type transistors $TR_4$ and $TR_4$ simultaneously with each other.

The turning-on of the transistor $TR_6$ gives the rising characteristic of a scanning voltage $V_S$ as shown in FIG. 7(*d*). The turning-on of the transistor $TR_4$ serves to charge a time-constant capacitor $C_r$ into the voltage $V_0$ rapidly. When the transistors $TR_4$ and $TR_6$ are turned off, an N-type transistor $TR_5$ is turned on to activate a P-type transistor $TR_7$ as a source follower to thereby change the charged voltage of the time-constant capacitor $C_r$ into low impedance, so that the scanning voltage $V_S$ having a falling characteristic as shown in FIG. 7(*d*) is put out. The time constant in the falling of the scanning voltage $V_S$ determined by the time-constant capacitor $C_T$ and the time-constant resistors $R_{1T}$ and $R_{2T}$.

When the N-type transistor $TR_5$ is turned on in the timing as shown in FIG. 7(*c*), the resistor $R_{2T}$ operates to shorten the time constant. The falling characteristic is shown in the solid line in FIG. 7(*d*). The broken line in FIG. 7(*d*) shows the case where the value of the resistor $R_{1T}$ is reduced to a small resistance value.

Further, a desired rising characteristic can be attained by addition of the same combination as the combination of the transistor $TR_5$ and the resistor $R_{2T}$.

The N-type transistor $TR_9$ is turned on as shown in FIG. 7(*b*) to change the level of the scanning voltage $V_S$ forcedly into the GND level. The transistor $TR_9$ is provided for the purpose of facilitating the operation of the transistor $TR_7$, because the transistor $TR_7$ as a source follower cannot operate when the gate voltage reaches a cut-off voltage, and because a considerably large time is required for changing the charged voltage of the capacitor $C_T$ into the GND level.

In the following, a further embodiment of the present invention will be described with reference to FIG. 8. FIG. 8 shows the case where not only the scanning voltage is generated based on a time constant formed by a capacitor and a resistor but the rising characteristic is determined based on the time constant. In FIG. 8, the scanning control means is not shown.

When the transistors $TR_4$ and $TR_5$ are turned on in the timing as shown in FIG. 9(*a*), the capacitor $C_T$ is charged through the resistor $R_{3T}$. The charged voltage of the capacitor $C_T$ is put out as the scanning voltage $V_S$ through low impedance of the N-type transistor $TR_{11}$ in a source follower connection. This is the rising portion of the scanning voltage shown in FIG. 9(*d*). The P-type transistor $TR_{12}$ serves to change the scanning voltage into a final voltage $V_o$.

When the transistors $TR_4$ and $TR_5$ are turned off, the transistor $TR_6$ is turned on to activate the transistor $TR_7$ to thereby output the scanning voltage $V_S$ having rising characteristic formed in the same manner as in FIG. 6. On the other hand, the falling of the scanning voltage is carried out by discharging the capacitor $C_T$ through the resistor $R_{4T}$ disposed between the capacitor $C_T$ and the transistor $TR_{13}$. FIGS. 9(*b*) and 9(*c*) show the timing of the turning-on of the transistor $TR_{12}$ and the timing of the turning-on of the transistor $TR_9$, respectively.

The scanning voltage $V_S$ formed as described above is shown in FIG. 9(*d*).

Also in the case of FIG. 8, a desired program can be attained by changing the time constant of the time-constant circuit or by addition of resistors and switching circuits.

In the following, the configuration of an embodiment of the level changer and the gating means which are also the constituent parts of the present invention will be described with reference to FIG. 10.

In FIG. 10, the reference numeral 50 designates a level changer constituted by a histable or flip-flop circuit composed of P-type transistors $TR_{14}$ and $TR_{15}$ and N-type transistors $TR_{16}$ and $TR_{17}$. The flip-flop circuit has an advantage in that power is consumed only when the state thereof is changed. The reference numeral 53 designates a signal of a level of about 5 V. The level of this signal is changed into the level of $V_o$ by the level changer 50. An N-type transistor $TR_{18}$ is turned on in the presence of the signal. On the other hand, and N-type transistor $TR_{19}$ is turned off because the signal is inverted by an invertor 52.

At this time, the transistors $TR_{14}$ and $TR_{17}$ are turned on, while the transistors $TR_{15}$ and $TR_{16}$ are turned off, so that $Q^1=1$ and $Q=0$, respectively. When the signal 53 is absent, $Q=Q^1=1=V_0$, respectively. In the level change through the transistor $TR_3$, electric power is consumed by the resistors $R_3$ and $R_4$ when the transistor $TR_3$ is in the ON state.

It is to be understood that the transistor $TR_5$ in FIG. 6 and the transistors $TR_6$ and $TR_8$ in FIG. 8 have a purpose of preventing damage of transistors caused by short-circuit of the electric source.

On the contrary, as described above, the level changer in FIG. 10 is constituted by a bistable or flip-flop circuit composed of four transistors. Accordingly, at least one of the transistors is in the OFF state against the electric source. Accordingly, current flowing occurs only in a transition period, so that power consumption is extremely small.

When the outputs $Q^1=1=V_0$ and $Q^1=0$ of the level changer 50, an N-type transistors $TR_{20}$ and a P-type transistor $TR_{21}$ in the gating means 51 are made conductive simultaneously with each other.

The gating means 51 carries out a two-way gating operation, so that the gating means 51 is used in common to two input/output devices $IO_1$ and $IO_2$ as shown by the two-head arrows.

Though not shown, in the case where the present invention applies to a serial printer, the gating means and the driving signal generating means can be constituted by transistors without using any other parts. Accordingly, the means can be prepared easily in the form of ICs.

If the gating means and the driving signal generating means prepared in the form of ICs are mounted on a carriage carrying an ink-jet printer head, the printer can be simplified in construction so that cost can be saved.

In the prior art, drive lines equal in number to the nozzles and two or four connection cables to the fixed portion are required. However, in this invention, only one connection cable is required and the number of connection lines can be reduced. As shown in FIG. 1, the total number of lines is eight, namely, two lines for the scanning voltage $V_S$, two electric source lines for the driving signal generating means, and four lines for the shift clock signal, the data signal, the latch pulse signal and the enable signal. Accordingly, cost can be saved.

Accordingly, the space factor in the fixed portion of the printer is improved to attain reduction both in size as well as in cost.

In the various embodiments of the present invention described above, it is a matter of course that various changes and modifications can be made.

As described above, according to the invention, a large effect arises in that both assembly cost and assembly space can be saved.

Because the scanning voltage is fed back to predetermined means and parts after conversion thereof into electromagnetic energy, heat generation and cost can be reduced when the scanning voltage is generated.

Furthermore, the portion including the driving signal generating means and the gating means can be constituted by pairs of P-type and N-type transistors. In this case, not only power consumption can be saved but these means can be prepared in the form of ICs. Accordingly, the present invention can make a large contribution to reliability and cost saving.

What is claimed is:

1. An ink jet printer driver comprising:

a plurality of electrostriction elements for jetting ink through nozzles onto a target to form a matrix of ink dots in a character pattern, each of the electrostriction elements having an inherent capacitance;

gating means for controlling driving of the electrostriction elements, the gating means including a plurality of gates each being coupled to one of the electrostriction elements and having a control terminal;

scanning voltage generating means, coupled to each of the gates, for generating a scanning voltage having a first predetermined waveform for driving the plurality of electrostriction elements, the scanning voltage generating means controlling rising and falling characteristics of the first predetermined waveform independent of the inherent capacitance of the electrostriction elements, the scanning voltage causing the inherent capacitance of the electrostriction elements to each store a voltage having a second predetermined waveform based on the scanning voltage; and control signal generating means for generating a plurality of control signals and supplying each of the control signals to the control terminal of a corresponding one of the gates to control each of the gates to enable the scanning voltage to drive the plurality of electrostriction elements in accordance with the control signals, the control signal generating means generating the plurality of control signals such that said each of the plurality of control signals causes said corresponding one of the gates to supply the scanning voltage to a corresponding one of the electrostriction elements for a predetermined amount of time during each period of time that the scanning voltage is at a maximum level to maintain the voltage stored in the inherent capacitance of each of the electrostriction elements at a predetermined value.

2. A driver as in claim 1, in which the scanning voltage generating means comprises first and second switching means for increasing and decreasing the scanning voltage wherein the first switching means defines a voltage rising characteristic of the scanning voltage and the second switching means defines a voltage falling characteristic of the scanning voltage, and a feedback circuit including coil means.

3. A driver as in claim 1, in which the scanning voltage generating means comprises a time constant circuit constituted by a resistor and a capacitor, a switching means for actuating the time constant circuit to operate in a predetermined cycle, and an amplifier for outputting the scanning voltage change caused in the time constant circuit as a low-impedance output signal.

4. A driver as in claim 1, 2 or 3, in which the ink-jet printer comprises a serial printer having a carriage which moves a printer head constituted by the nozzles and the plurality of ink jetting means, and in which the gating means and the driving signal generating means are mounted on the carriage.

5. An ink jet printer driver comprising:

a plurality of electrostriction elements for jetting ink through nozzles onto a target to form a matrix of ink dots in a character pattern, each of the electrostriction elements having an inherent capacitance;

gating means for controlling driving of the electrostriction elements, the gating means including a plurality of gates each being coupled to one of the electrostriction elements and having a control terminal;

scanning voltage generating means, coupled to each of the gates, for generating a scanning voltage having a first predetermined waveform for driving the plurality of electrostriction elements, the scanning voltage generating means comprising a time constant circuit coupled in series to an electric source by at least one switching means, and amplifier means coupled in series to the electric source including a pair of transistors of which at least one is responsive to an electric potential in the time constant circuit, the scanning voltage generating means controlling rising and falling characteristics of the first predetermined waveform independent of the inherent capacitance of the electrostriction elements, the scanning voltage causing the inherent capacitance of the electrostriction elements to each store a voltage having a second predetermined waveform based on the scanning voltage;

control signal generating means for generating a plurality of control signals in a predetermined timing and supplying each of the control signals to the control terminal of a corresponding one of the gates to control each of the gates to enable the scanning voltage to drive the plurality of electrostriction elements in accordance with the control signals, the control signal generating means generating the plurality of control signals such that said each of the plurality of control signals causes said corresponding one of the gates to supply the scanning voltage to a corresponding one of the electrostriction elements for a predetermined amount of time during each period of time that the scanning voltage is at a maximum level to maintain the voltage stored in the inherent capacitances of each of the electrostriction elements at a predetermined value; and scanning voltage control means for controlling the scanning voltage generating means in cooperation with the control signal generating means.

6. A driver as in claim 5 further comprising time constant changing means for changing the time constant of the time constant circuit.

7. An ink jet printer driver comprising:

a plurality of ink jetting means for jetting ink onto a target to form a matrix of ink dots in a character pattern, each of the ink jetting means having an inherent capacitance;

gating means for controlling driving of the ink jetting means, the gating means including a plurality of gates each being coupled to one of the ink jetting means and having a control terminal;

scanning voltage generating means, coupled to each of the gates, for generating a scanning voltage having a first predetermined waveform for driving the plurality of ink jetting means, the scanning voltage generating means controlling rising and falling characteristics of the first predetermined waveform independent of the inherent capacitance of the ink jetting means, the scanning voltage causing the inherent capacitance of the ink jetting means to each store a voltage having a second predetermined waveform based on the scanning voltage; and control signal generating means for generating a plurality of control signals and supplying each of the control signals to the control terminal of a corresponding one of the gates to control each of the gates to enable the scanning voltage to drive the plurality of ink jetting means in accordance with the control signals, the control signal generating means generating the plurality of control signals such that said each of the plurality of control signals causes said one of the gate to supply the scanning voltage to a corresponding one of the ink jetting means for a predetermined amount of time during each period of time that the scanning voltage is at a maximum level to maintain the voltage stored in the inherent capacitance of each of the ink jetting means at a predetermined value.

8. A driver as in claim 7, in which the scanning voltage generating means comprises first and second switching means for increasing and decreasing the scanning voltage wherein the first switching means defines the rising characteristic of the scanning voltage and the second switching means defines the falling characteristic of the scanning voltage, and a feedback circuit including coil means.

9. A driver as in claim 7, in which the scanning voltage generating means comprises a time constant circuit constituted by a resistor and a capacitor, a switching means for actuating the time constant circuit to operate in a predetermined cycle, and an amplifier for outputting the scanning voltage change caused in the time constant circuit as a low-impedance output signal.

10. A driver as in claim 7, 8 or 9, in which the ink-jet printer comprises a serial printer having a carriage which moves a printer head constituted by the plurality of ink jetting means, and in which the gating means and the driving signal generating means are mounted on the carriage.

11. An ink jet printer driver comprising:

a plurality of ink jetting means for jetting ink onto a target to form a matrix of ink dots in a character pattern, each of the ink jetting means having an inherent capacitance;

gating means for controlling the ink jetting means, the gating means including a plurality of gates each being coupled to one of the ink jetting means and having a control terminal;

scanning voltage generating means, coupled to each of the gates, for generating a scanning voltage having a first predetermined waveform for driving the plurality of ink jetting means, the scanning voltage generating means controlling rising and falling characteristics of the first predetermined waveform independent of the inherent capacitance of the ink jetting means, the scanning voltage causing the inherent capacitance of the ink jetting means to each store a voltage having a second predetermined waveform based on the scanning voltage; and control signal generating means for generating a plurality of control signals and supplying each of the control signals to the control terminal of a corresponding one of the gates to control each of the gates to enable the scanning voltage to drive the plurality of ink jetting means in accordance with the control signals, the control signal generating means generating the plurality of control signals such that said each of the plurality of control signals causes said one of the gates to supply the scanning voltage to a corresponding one of the ink jetting means for a predetermined amount of time during each period of time that the scanning voltage is at a maximum level to maintain the voltage stored in the inherent capacitance of each of the ink jetting means at a predetermined value; and a scanning voltage control means for controlling the scanning voltage generating means in cooperation with the control signal generating means.

12. An ink jet printer driver comprising:

a plurality of ink jetting means for jetting ink onto a target to form a matrix of ink dots in a character pattern, each of the ink jetting means having an inherent capacitance;

gating means for controlling driving of the electrostriction elements, the gating means including a plurality of gates each being coupled to one of the ink jetting means and having a control terminal;

scanning voltage generating means, coupled to each of the gates, for supplying a scanning voltage having a first predetermined waveform for driving the plurality of ink jetting means, the scanning voltage generating means comprising a time constant circuit coupled in series to an electric source by at least one switching means, and amplifier means coupled in series to the electric source including a pair of transistors of which at least one is responsive to an electric potential in the time constant circuit, the scanning voltage generating means controlling rising and falling characteristics of the first predetermined waveform independent of the inherent capacitance of the ink jetting means, the scanning voltage causing the inherent capacitance of the ink jetting means to each store a voltage having a second predetermined waveform based on the scanning voltage;

control signal generating means for generating a plurality of control signals in a predetermined timing and supplying each of the control signals to the control terminal of a corresponding one of the gates to control each of the gates to enable the scanning voltage to drive the plurality of ink jetting means in accordance with the control signals, the control signal generating means generating the plurality of control signals such that said each of the plurality of control signals causes said corresponding one of the gate to supply the scanning voltage to a corresponding one of the ink jetting means for a predetermined amount of time during each period of time that the scanning voltage is at a maximum level to maintain the voltage stored in the inherent capacitance of each of the ink jetting means at a predetermined value; and scanning voltage control means for controlling the scanning voltage generating means in cooperation with the control signal generating means.

13. A driver as in claim 11 or 12 further comprising time constant changing means for changing the time constant of the time constant circuit.

* * * * *